US009955783B1

(12) United States Patent
Lu

(10) Patent No.: US 9,955,783 B1
(45) Date of Patent: May 1, 2018

(54) DOOR CONTROL DEVICE FOR ELECTRIC APPLIANCE CABINET

(71) Applicant: Dong Guan Song Wei Electric Technology Co., Ltd., Dongguan (CN)

(72) Inventor: Weilin Lu, Dongguan (CN)

(73) Assignee: DONG GUAN SONG WEI ELECTRIC TECHNOLOGY CO., LTD., Dongguan, Guangdong (CN)

( * ) Notice: Subject to any disclaimer, the term of this patent is extended or adjusted under 35 U.S.C. 154(b) by 0 days. days.

(21) Appl. No.: 15/340,994

(22) Filed: Nov. 2, 2016

(51) Int. Cl.

| | |
|---|---|
| ***H01H 9/00*** | (2006.01) |
| ***A47B 81/06*** | (2006.01) |
| ***A47B 97/00*** | (2006.01) |
| ***E06B 5/00*** | (2006.01) |
| ***E05F 15/652*** | (2015.01) |
| ***F24C 7/08*** | (2006.01) |
| ***F24B 1/18*** | (2006.01) |

(52) U.S. Cl.
CPC ..... *A47B 81/06* (2013.01); *A47B 97/00* (2013.01); *E05F 15/652* (2015.01); *E06B 5/00* (2013.01); *F24B 1/1808* (2013.01); *F24C 7/08* (2013.01); *A47B 2220/0091* (2013.01)

(58) Field of Classification Search
CPC ..... A47K 4/00; E05F 3/00; G01N 21/018803; G01N 21/95; G01N 2201/025
USPC ..... 335/205
See application file for complete search history.

(56) References Cited

U.S. PATENT DOCUMENTS

| | | | | |
|---|---|---|---|---|
| 5,955,795 | A * | 9/1999 | Beer | F24C 15/12 219/452.13 |
| 6,059,196 | A * | 5/2000 | Miyazaki | F24F 3/16 165/918 |
| 8,225,458 | B1 * | 7/2012 | Hoffberg | E05F 3/102 16/49 |
| 9,687,134 | B2 * | 6/2017 | Baldwin | A47L 15/4293 |
| 2008/0309211 | A1 * | 12/2008 | Wilson | F24C 15/02 312/410 |
| 2013/0125937 | A1 * | 5/2013 | Baldwin | A47L 15/4293 134/56 D |
| 2013/0205825 | A1 * | 8/2013 | Coulter | F25D 11/02 62/344 |
| 2013/0228202 | A1 * | 9/2013 | Welch | A47L 15/4259 134/200 |
| 2013/0232685 | A1 * | 9/2013 | Cornille | A47K 4/00 4/663 |
| 2014/0083309 | A1 * | 3/2014 | Reese | A47J 39/003 99/474 |
| 2014/0224591 | A1 * | 8/2014 | Garcia | B66B 11/0005 187/251 |
| 2015/0118107 | A1 * | 4/2015 | Sunkara | A61L 2/24 422/24 |

(Continued)

*Primary Examiner* — Shawki S Ismail
*Assistant Examiner* — Lisa Homza
(74) *Attorney, Agent, or Firm* — Leong C. Lei

(57) ABSTRACT

A door control device for an electric appliance cabinet includes a cabinet and sensor; doors are configured on the front side face of the cabinet body, and the sensor is configured inside the cabinet body and senses the opening or closing of the doors and controls the electric appliance inside the cabinet body to turn on or off. The sensor being configured and used to detect the opening or closing of the doors to turn on and then off the appliance automatically correspondingly realizes an intelligent control.

9 Claims, 6 Drawing Sheets

(56) References Cited

U.S. PATENT DOCUMENTS

| | | | | |
|---|---|---|---|---|
| 2016/0068797 | A1* | 3/2016 | Kuzan | B65B 43/40<br>53/468 |
| 2017/0024946 | A1* | 1/2017 | Hashemi | A47G 29/141 |

* cited by examiner

DOOR CONTROL DEVICE FOR ELECTRIC APPLIANCE CABINET

TECHNICAL FIELD OF THE INVENTION

The present invention relates to a control device, and more particularly to a door opening and closing control device, applied to electric fireplace cabinet, TV cabinet, or the like.

DESCRIPTION OF THE PRIOR ART

To protect electric appliances from dust or damage, many home electric appliances (e.g. electric fireplaces, stereos, and the like) are usually placed inside wood cabinets, and the doors of the cabinets are opened upon the use of the electric appliance placed therein and closed while not in use so as to have a dustproof effect for the electric appliances.

However, in practical use, an electric appliance must be turned on manually when the doors of the cabinet are opened, and turned off manually when they are closed such that is inconvenient for the operation of a user, and incapable of the perfect combination of the wood cabinet with the electric appliance therein.

SUMMARY OF THE INVENTION

The main object of the present invention is to provide a door control device for an electric appliance cabinet, capable of turning on or off an electric appliance placed inside the cabinet automatically and allowing the cabinet to be in perfect combination with the electric appliance.

To achieve the object above, the present invention proposes a door control device for an electric appliance cabinet, including a cabinet body and sensor, an accommodation space for the accommodation of an electric appliance being defined inside the cabinet body, doors being configured on a front side face of the cabinet body, the sensor being configured inside the cabinet body and sensing the opening or closing of the doors, and the sensor controlling said electric appliance inside the cabinet body to turn on or off automatically; when the doors are in an open state, the sensor controlling the electric appliance inside the cabinet body to turn on automatically, and when the doors are in a close state, the sensor controlling the electric appliance inside the cabinet body to turn off automatically.

Preferably, a slide rail is configured on the cabinet body, and slide wheels are respectively configured on the doors, each slide wheel being pressed against said slide rail and moved back and forth along the slide rail to allow the doors to be opened or closed.

Preferably, the sensor is configured on the electric appliance.

Preferably, the sensor is a magnetic controller, proximity switch or infrared signal sensor.

Preferably, a magnet adapted to control the close or disconnection of the magnetic controller is configured on the door.

Preferably, the doors are opened manually or by a driving mechanism.

Preferably, the driving mechanism includes a motor and slide screw rod in connection with the doors, and the motor drives the slide screw rod to rotate.

Preferably, the motor is configured on the slide rail or one side of the door.

Preferably, the present invention further includes an infrared signal receiver in connection with a master control acquisition and command processing module, and the motor, sensor and electric appliance are all connected to the master control acquisition and command processing module.

Preferably, the doors number at least one.

The present invention has the following advantages compared to the prior art:

the sensor is configured to sense the door opening or closing, thereby turning on and then off the electric appliance automatically and correspondingly, realizing intelligent control; the entire structure of the wood cabinet is allowed to be more compact and reasonable, and the outlook thereof is more eye-appealing, increasing the use quickness and practicality for customers. In addition, the present invention breaks through the design styles of current electric fireplace wood cabinets, changes the design concepts of traditional electric appliance cabinet, and further allows the wood cabinet to be in perfect combination with an electric fireplace, forming a real sense of overall aesthetics

DETAILED DESCRIPTION OF THE PREFERRED EMBODIMENTS

Figure 1:
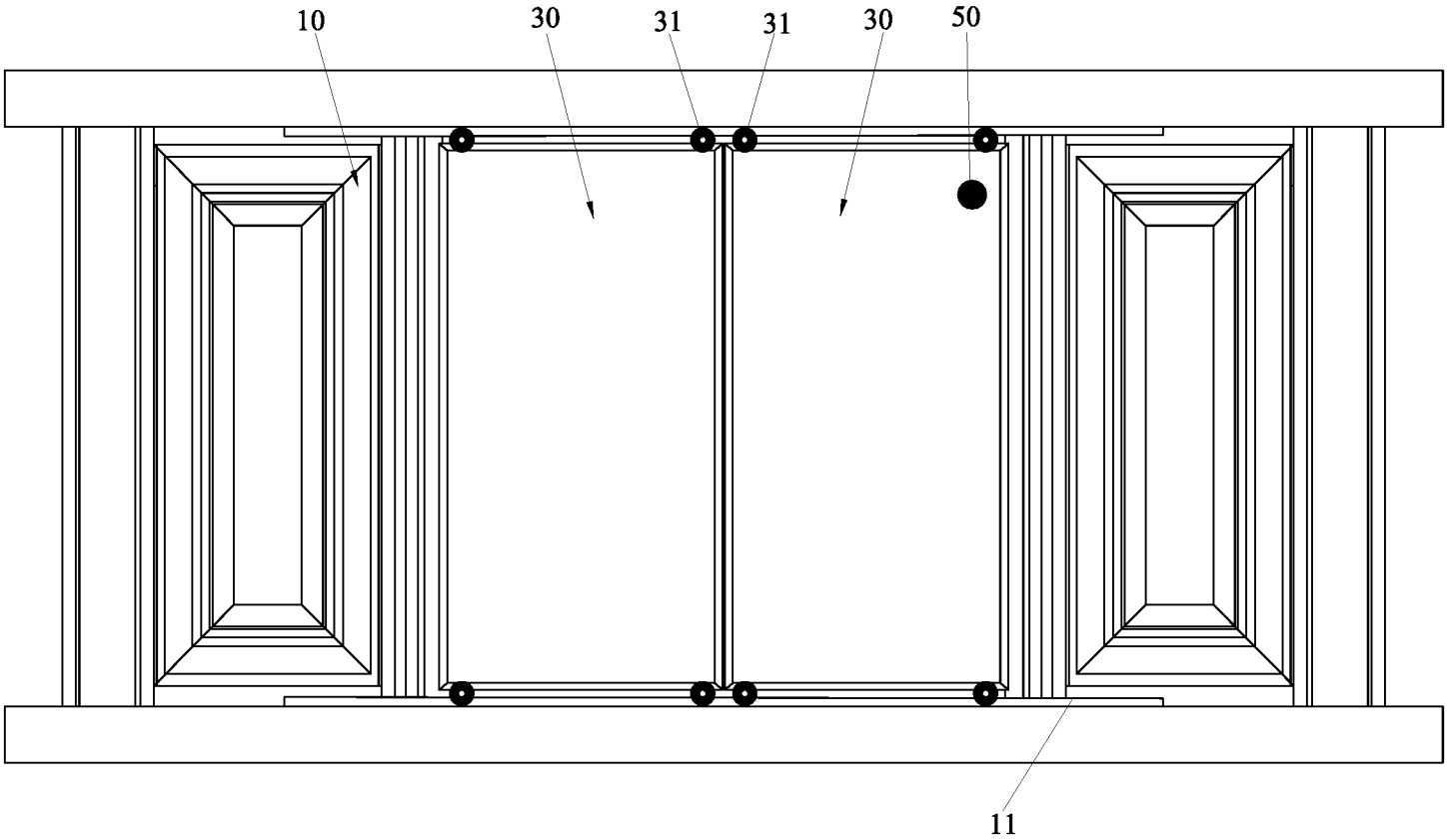
FIG. 1 is a schematic view of a preferred embodiment of the present invention, where doors are in a close state.
Figure 2:
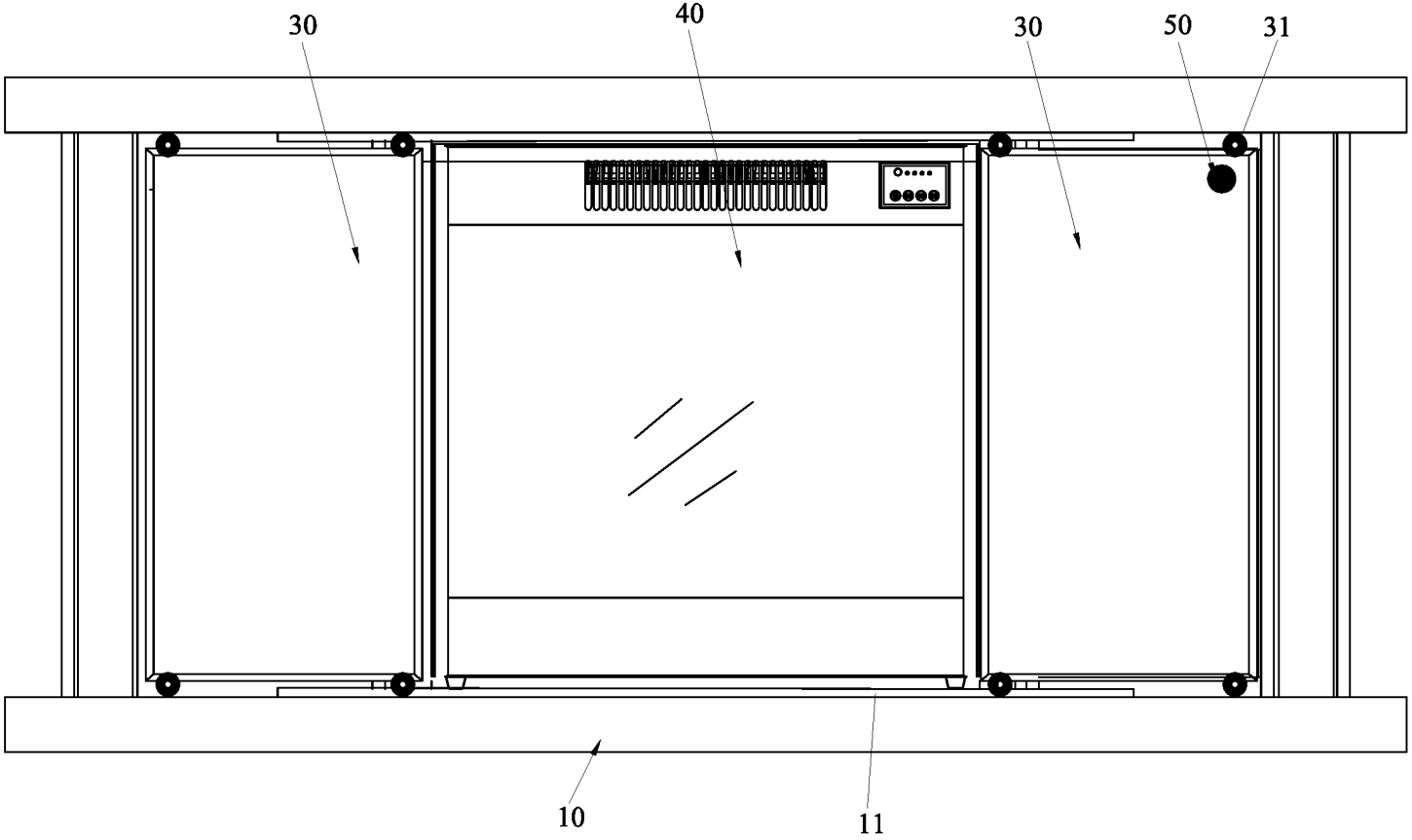
FIG. 2 is a schematic view of the embodiment of the present invention, where the doors are in an open state.
Figure 3:
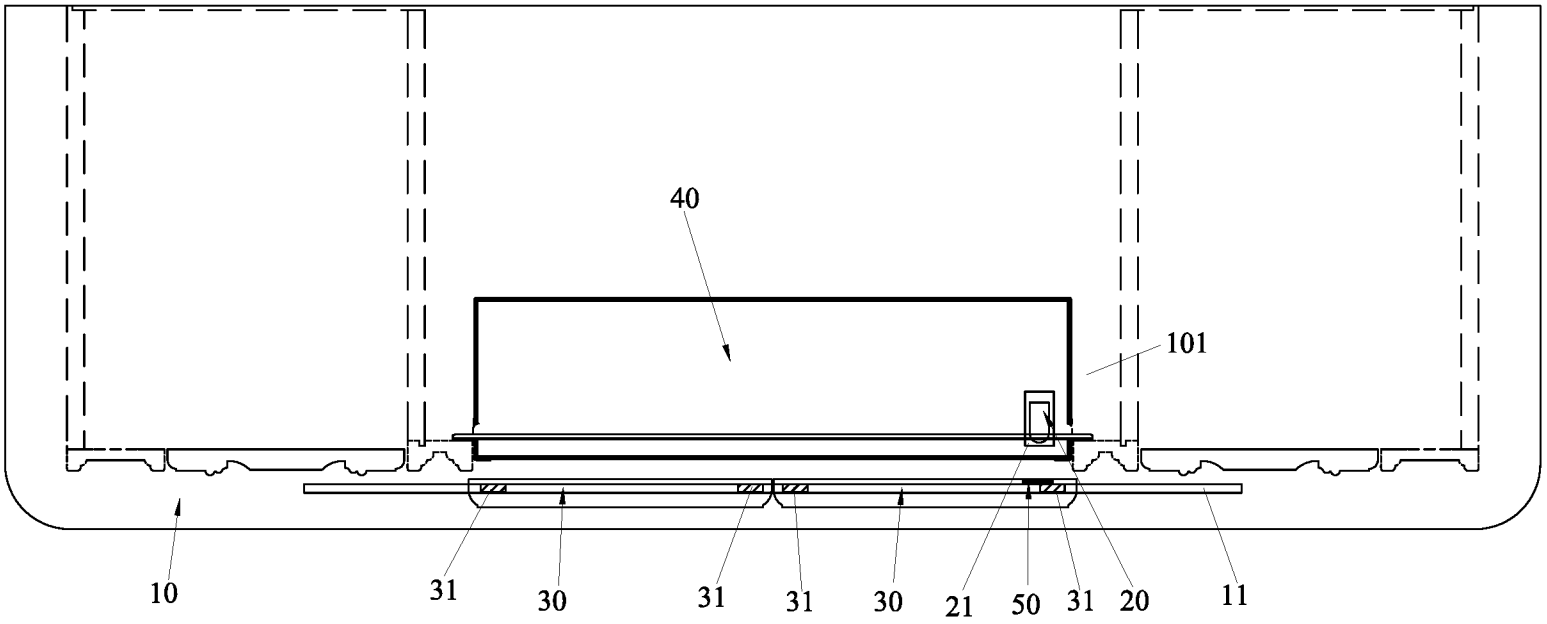
FIG. 3 is a cross-sectional view of the embodiment of the present invention, where the doors are in a close state.
Figure 4:
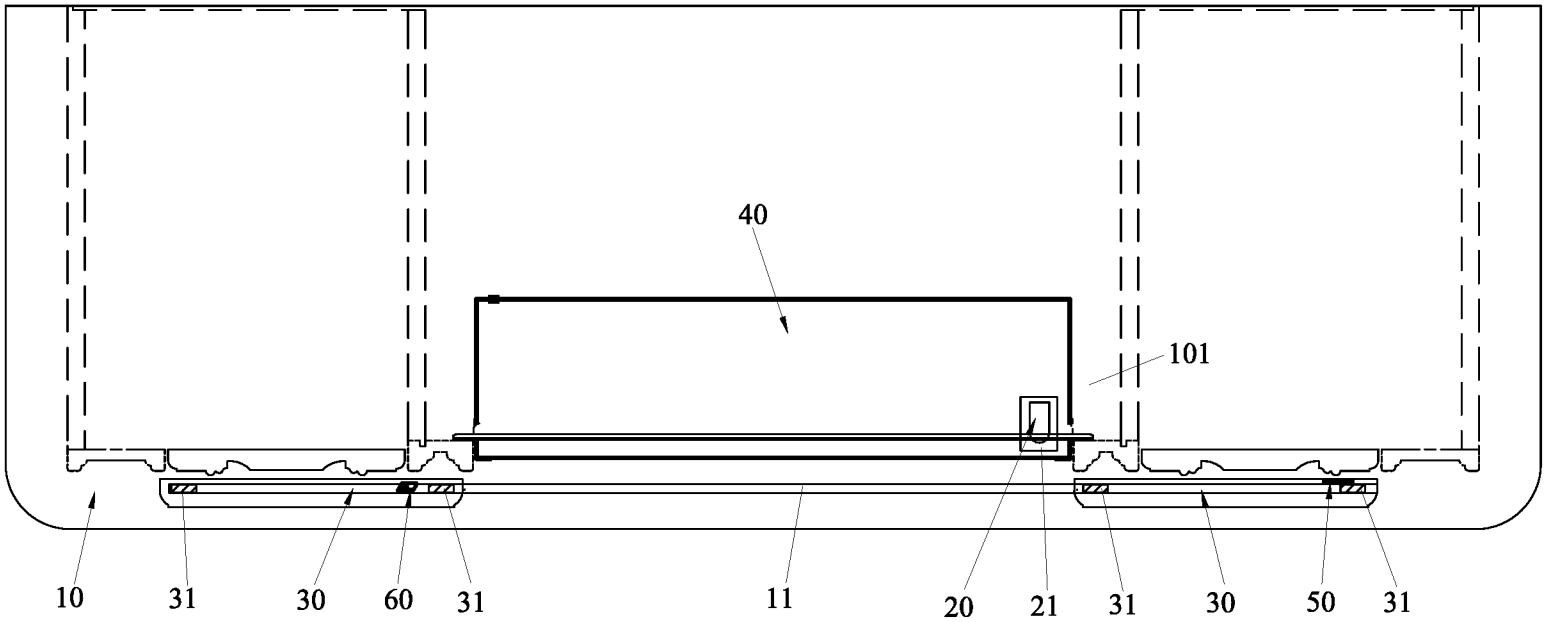
FIG. 4 is a cross-sectional view of the embodiment of the present invention, where the doors are in an open state.
Figure 5:
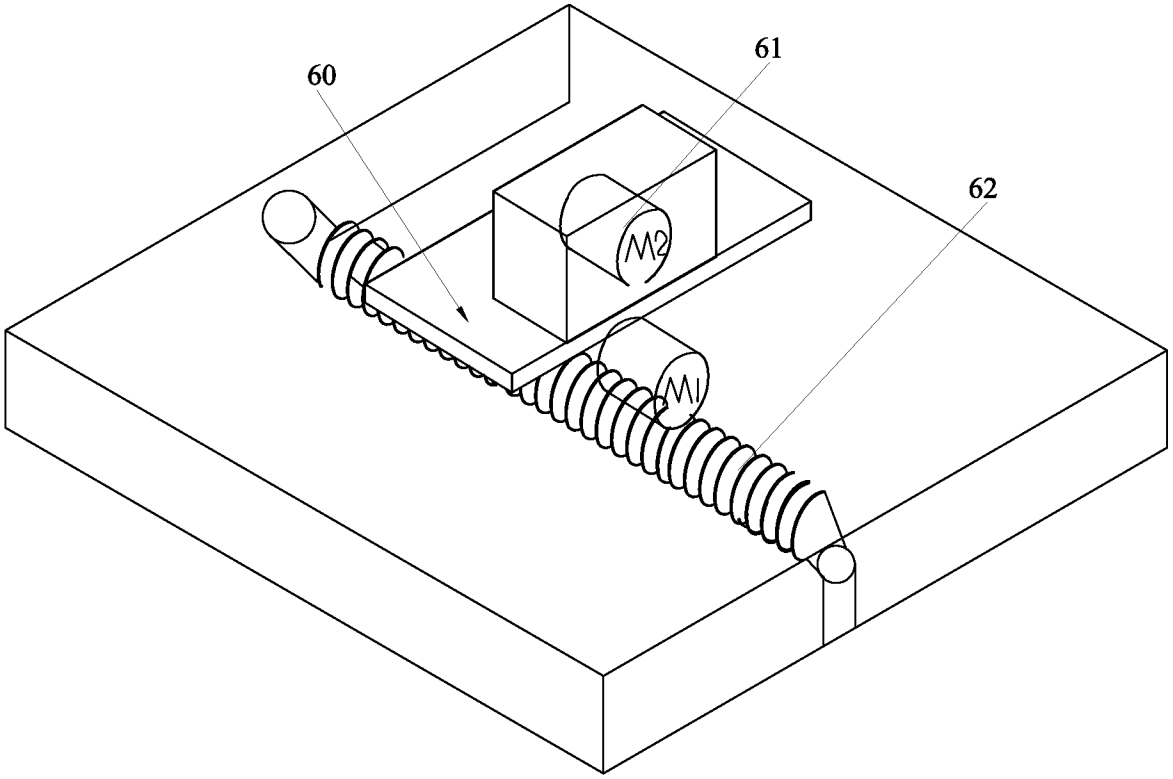
FIG. 5 is an enlarged perspective view of a driving mechanism according to the embodiment of the present invention.
Figure 6:
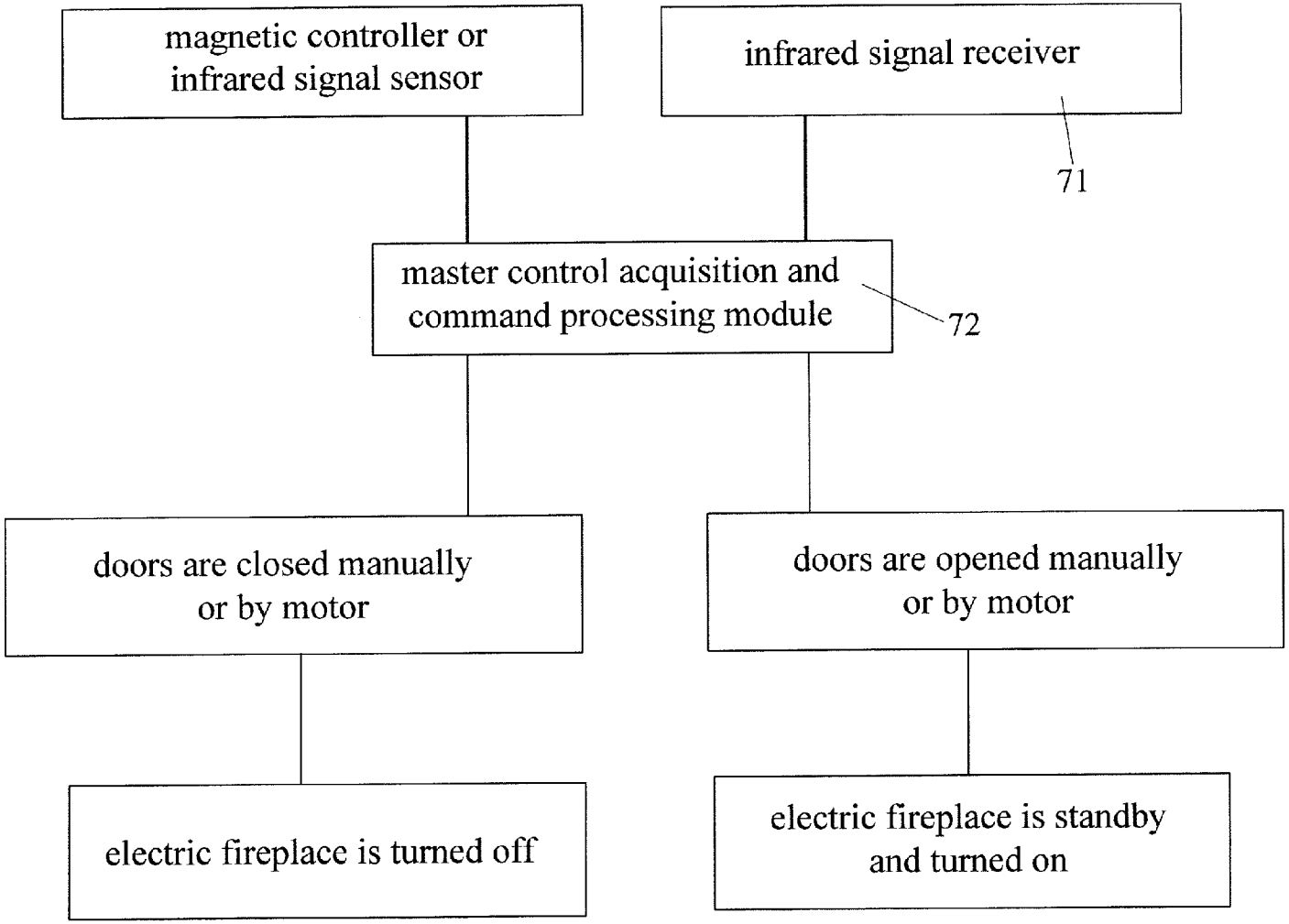
FIG. 6 is a working diagram of the embodiment of the present invention.

Referring to FIGS. 1 to 6, which show a specific structure of a preferred embodiment of the present invention, the structure is applied to electric fireplace cabinets and TV cabinets and includes a cabinet body 10 and sensor 20.

An accommodation space 101 is defined inside the cabinet body 10 for the accommodation of an electric appliance 40, and doors 30 are configured on the front side face of the cabinet body 10. In the embodiment, the doors 30 number 2 respectively configured right and left, but not so limited and there may only be one door 30. Furthermore, a slide rail 11 is configured on the cabinet body 10, and slide wheels 31 are respectively configured on the doors 30, where each slide wheel 31 is pressed against the slide rail 11 and moved back and forth along the slide rail 11 to allow the doors to be opened or closed quickly.

The sensor 20 is used for detecting whether there is a door closing change or door opening change that meets a preset condition in front of the electric appliance 40, performing signal judgment to turn on or off the appliance 40. The sensor 20 is configured inside the cabinet 10 and senses whether the doors 30 is opened or closed. In addition, the sensor 20 controls the automatic turning-on or turning-off of the appliance 40 placed inside the cabinet body 10; when the doors 30 are opened, the sensor 20 controls the electric appliance 40 placed inside the cabinet body 10 to turn on automatically, and when the doors 30 are closed, the sensor 20 controls the electric appliance 40 to turn off automatically. Herein, the outside of the sensor 20 is covered or put around with an insulating sleeve 21.

In the embodiment, the sensor 20 is configured on the electric appliance 40, the electric appliance may be an electric fireplace or another electric appliance, and the sensor 20 is a magnetic controller, proximity switch or infrared signal sensor. When the magnetic controller is used, a magnet 50 is configured on the door 30 for controlling the magnetic controller to close or disconnect. Herein, the magnet 50 may be configured on the door 30 or the slide rail 11 so that it can be moved with the door 30 through the moving thrust of the door 30.

Furthermore, the doors 30 may be opened manually or by a driving mechanism 60, In the embodiment, taking the driving mechanism 60 as an example to describe, the driving mechanism 60 includes a motor 61 and slide screw rod 62, where the slide screw rod 62 is in connection with the doors 30, and the motor 61 drives the slide screw rod 62 to rotate, thereby realizing the automatic opening or closing of the doors 30; the motor 61 is configured on the slide rail 11 or one side of the door 30, but the present invention is not limited thereto. Furthermore, the present invention further includes an infrared signal receiver 71 in connection with a master control acquisition and command processing module 72, where the motor 61, sensor 20 and electric appliance 40 are all in connection with the master control acquisition and command processing module 72. Thereupon, the master control acquisition and command processing module 72 is used for identifying a door opening or closing action while detecting an infrared reflecting signal or magnetic field change meeting a preset condition.

The working process of the embodiment of the present invention is described in detail as the following:

when the sensor 20 senses that the doors 30 are closed, magnetic force generated from the magnet 50 will cause the magnetic controller to be closed and conducted to generate a signal to transmit to the master control acquisition and command processing module 72, thereby outputting a two-way control signal; one signal controls the motor 61 to close the doors 30, and another signal is transmitted to the electric appliance (electric fireplace) 40 inside the cabinet 10, allowing it to be turned off automatically, and when the sensor 20 senses that the doors are opened, the magnetic force generated from the magnet 50 is far away from the magnetic controller, causing the magnetic controller to be disconnected to generate a disconnection signal, which is transmitted to the master control acquisition and command processing module 72 to output a two-way control signal; one signal controls the motor 61 to turn on the doors 30, and another signal is transmitter the electric appliance 40 (electric fireplace) inside the cabinet body 10, allowing it to be in a standby state automatically and turned on. Meanwhile, an infrared signal may be emitted through a remote controller and transmitted to the master control acquisition and command processing module 72 through the infrared signal receiver 71, thereby controlling automatically the doors 30 to be opened or closed quickly, and at the same time, the electric appliance 40 will also be turned on or off automatically, thereby realizing intelligent automatic control.

The present invention has the following advantages compared to the prior art:

the sensor is configured to sense the door opening or closing, thereby turning on and then off the electric appliance automatically and correspondingly, realizing intelligent control; the entire structure of the wood cabinet is allowed to be more compact and reasonable, and the outlook thereof is more eye-appealing, increasing the use quickness and practicality for customers. In addition, the present invention breaks through the design styles of current electric fireplace wood cabinets, changes the design concepts of traditional electric appliance cabinet, and further allows the wood cabinet to be in perfect combination with an electric fireplace, forming a real sense of overall aesthetics

I claim:

1. A door control device for an electric appliance cabinet, comprising a cabinet body and sensor, an accommodation space for the accommodation of an electric appliance being defined inside said cabinet body, doors being configured on a front side face of said cabinet body, said sensor being configured inside said cabinet body and sensing the opening or closing of said doors, and said sensor controlling said electric appliance inside said cabinet body to turn on or off automatically; when said doors are in an open state, said sensor controlling said electric appliance inside said cabinet body to turn on automatically, and when said doors are in a close state, said sensor controlling said electric appliance inside said cabinet body to turn off automatically; wherein a slide rail is configured on said cabinet body, and slide wheels are respectively configured on said doors, each said slide wheel being pressed against said slide rail and moved back and forth along said slide rail to allow said doors to be opened or closed.

2. The device according to claim 1, wherein said sensor is configured on said electric appliance.

3. The device according to claim 1, wherein said sensor is a magnetic controller, proximity switch or infrared signal sensor.

4. The device according to claim 3, wherein a magnet adapted to control the close or disconnection of said magnetic controller is configured on said door.

5. The device according to claim 1, wherein said doors are opened manually or by a driving mechanism.

6. The device according to claim 5, wherein said driving mechanism comprises a motor and slide screw rod in connection with said doors, and said motor drives said slide screw rod to rotate.

7. The device according to claim 6, wherein said motor is configured on said slide rail or one side of said door.

8. The device according to claim 5, further comprising an infrared signal receiver in connection with a master control acquisition and command processing module, and said motor, sensor and electric appliance being all connected to said master control acquisition and command processing module.

9. The device according to claim 1, wherein said doors number at least one.

* * * * *